US006824219B2

(12) United States Patent
Rückstädter

(10) Patent No.: US 6,824,219 B2
(45) Date of Patent: Nov. 30, 2004

(54) ERGONOMIC OFFICE CHAIR WITH AN EXTENDING FOOT

(76) Inventor: Hans Rückstädter, Eichengrund 12, D-59227 Ahlen (DE)

( * ) Notice: Subject to any disclaimer, the term of this patent is extended or adjusted under 35 U.S.C. 154(b) by 0 days.

(21) Appl. No.: 10/311,512

(22) PCT Filed: Jun. 11, 2001

(86) PCT No.: PCT/DE01/02203

§ 371 (c)(1),
(2), (4) Date: Dec. 16, 2002

(87) PCT Pub. No.: WO01/97657

PCT Pub. Date: Dec. 27, 2001

(65) Prior Publication Data

US 2003/0173808 A1 Sep. 18, 2003

(30) Foreign Application Priority Data

Jun. 17, 2000 (DE) ..... 100 30 022

(51) Int. Cl.[7] ..... A47C 1/034
(52) U.S. Cl. ..... 297/423.27; 297/317; 297/320; 297/342; 297/423.21

(58) Field of Search ..... 297/318, 322, 297/342, 343, 423.11, 423.13, 423.19, 423.21, 423.26, 423.27, 423.28, 317, 341, 320

(56) References Cited

U.S. PATENT DOCUMENTS

| | | | | | |
|---|---|---|---|---|---|
| 4,408,801 | A | * | 10/1983 | Edel et al. | 297/423.38 |
| 4,765,684 | A | * | 8/1988 | Kvalheim et al. | 297/423.13 |
| 5,152,581 | A | * | 10/1992 | Norsworthy | 297/423.28 |
| 5,255,957 | A | * | 10/1993 | Opsvik et al. | 297/423.12 |
| 5,542,746 | A | * | 8/1996 | Bujaryn | 297/423.12 |
| 5,667,278 | A | * | 9/1997 | Li | 297/423.13 |

* cited by examiner

*Primary Examiner*—Peter R. Brown
(74) *Attorney, Agent, or Firm*—Brown & Michaels, PC

(57) ABSTRACT

An ergonomic chair having an extending foot and the possibility of swiveling with tilting of the chair backrest synchronized with horizontal movement of the chair seat. It is intended for the linkage system to be installed on a swivel chair. With this (office) chair, it is intended to synchronize the tilt of the backrest with the forward movement of the seat in such a way that the distance of the seat occupant's hands relative to the work equipment on the desk top remains virtually constant at all times.

19 Claims, 6 Drawing Sheets

ERGONOMIC OFFICE CHAIR WITH AN EXTENDING FOOT

BACKGROUND OF THE INVENTION

1. Field of the Invention

The invention pertains to the field of furniture. More particularly, the invention pertains to the field of chairs having extending feet or other supports.

2. Description of Related Art

The ergonomics of sitting for protracted periods requires regular changes in body posture. Rubber ball seats and spring-mounted chairs do not offer the body any possibility of rest and have to be constantly rebalanced. There are inventions for chairs which link backward tilting of the chair backrest with forward movement of the chair seat. In the case of the known inventions, the movement of the chair seat is normally effected by complicated systems of levers which, however, permit too little horizontal movement of the seat.

Especially for non-swivel chairs, this (synchronised) idea, although invented in these cases for other reasons, has long been known, e.g. Swiss patent CH 26 97 55. In this case, the seat and backrest, which are linked by a swivel joint, together with a top mounted supporting surface, can even be turned into a horizontal table, whereby the seat moves forward a long way and the backrest and supporting surface can be lowered until completely flat.

As a rule, however, the reason for the design of such synchronised chairs is to enable a comfortable sitting position to be achieved. An example for technology allowing (some) forward movement of the chair seat is shown for a swivel chair in European published patent application EP 0 460 717 A2, although in this case a bolt device is claimed as the patent for this movement. The backward tilt of the chair backrest, which is attached to the seat by a swivel joint, is made possible by the armrests, mounted movably on swivel joints, which serve as the main holding levers for the backrest. A tension spring mounted under the seat counteracts the weight of the occupant exerted on the backrest. The angle of the seat is thereby also changed slightly.

Another example of movable seat technology is shown in German patent application DE 33 15 237 A1. In this case, however, the backrest is held not by the armrests but directly in mounts on the base of the chair, as is also the seat, though this slides forward when the backrest is tilted.

In these known swivel chairs, however, the horizontal movement of the seat is intentionally kept very low as, with any greater forward movement, the chair with its occupant would be in danger of tipping forwards. Their inventors have, therefore, not produced designs which would allow the goals stated in the introduction to be genuinely achieved. The alternative would have been to reserve an enormous space on the floor to provide supporting feet for the chair, which has naturally not been done. Nor is it feasible to bolt office chairs to the floor. A magnetically switchable adhesion system would be the best alternative solution in this case, but the intended purpose would nevertheless not be achieved as the horizontal movement needs to be 30 to 35 cm to offset a tilt in the chair backrest of approx. 30 to 40 degrees. Rubber ball sets represent are only a makeshift solution as they do not solve the problem of distance, and with the need for the occupant to continually adjust his/her balance there is a risk of falling off. And while allowing different sitting positions, they do not have a backrest to provide support for the spine.

The objective is to design a chair which allows horizontal movement of the seat both without effort and without noise disturbance. At the same time, the benefits and dimensions of a normal swivel office chair should be preserved as far as possible, at least in the normal sitting position.

Various approaches can be adopted for achieving this objective. The base of a swivel (office) chair normally consists of five feet and the familiar gas spring mechanism for vertical height adjustment. The known approach to the technical task relating to the chair seat and backrest employs lever mechanics, combined with a (too) small sliding movement so as to prevent the center of gravity from moving too far forward.

SUMMARY OF THE INVENTION

A recognized benefit of changing sitting positions on a chair is achieved by new combinations of several elements, some of which are already known, but which through logical linking are made dependent on one another in respect of their movement. The position of the extended hand relative to the work desk remains almost unchanged while the seat moves backwards and forwards on the chair and the backrest tilts. The swivel chair retains its normal function as long as the backrest is not sharply tilted. When the linking is completely decoupled and the backrest is able to tilt without movement of the seat, the chair behaves like a normal chair.

The invention relates to linking an extending foot and the possibility of swiveling with tilting of the chair backrest synchronized with horizontal movement of the chair seat. It is intended for the linkage system to be installed on a swivel chair. With this (office) chair, it is intended to synchronize the tilt of the backrest with the forward movement of the seat in such a way that the distance of the seat occupant's hands relative to the work equipment on the desk top remains virtually constant at all times.

DETAILED DESCRIPTION OF THE INVENTION

The new design approach allows above all for sufficient sliding movement, which can additionally be supported by the possibility of small lever movements to achieve the desired angle of the seat. The centre of gravity is thereby moved forward significantly, with the result that the chair would be in danger of tipping forward unless counteracted by additional structural elements. The possibility of employing a large support area on the floor cannot be considered, as potential users would not buy such chairs.

Figure 5:
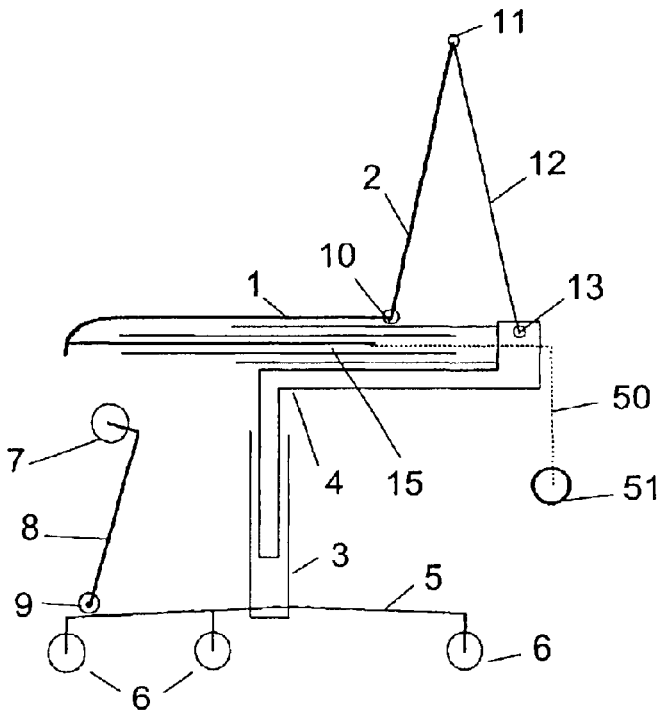
FIG. 5 shows a schematic side view of the chair of the invention, having a hinged or swiveling movable foot and a weight to effect return of the seat.
Figure 6:
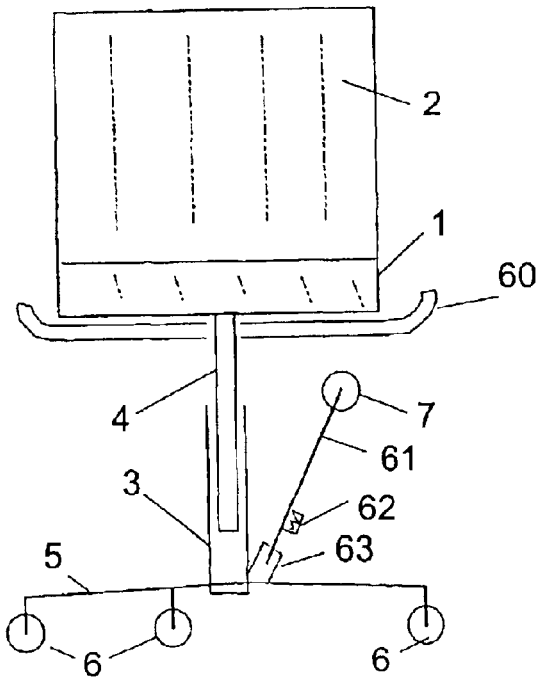
FIG. 6 shows a schematic front view of the chair of the invention.

The risk of tipping over could be prevented by heavy weights mounted movably or immovably on the chair, e.g. in the form of large, half-moon-shaped weights suspended underneath at the back on the lower pivot point of the backrest lever or the base, for instance between all or some of the foot segments. This solution would also be likely to prove unpopular as it would push up the costs for production and transport and the chair itself would be seen as a monstrosity. Repositioning of the chair seat by weights would also mean a constant pulling force, contrary to the situation with return springs. (FIG. 5)

A solution of the intended kind can also be achieved by one or more extending feet (7) which slide or fold out in the frontward direction. Before movement of the seat (1), an additional foot (7) is positioned between the feet/legs of the user. A fold-out foot (7)(8)(9) (all figs. except 3) has the advantage of being less problematic in terms of operation and durability as it is a mechanical system; on the other hand, however, when the chair is not in use, it is visually less attractive. The fold-down movement can be either vertical or even diagonal, allowing a somewhat longer extension under the chair. A foot pedal is provided on the side of the fold-out foot to allow the foot to be extended by the occupant's foot, as well as a lever for releasing this extended foot after use. The extended foot can either lock in place or be held down by a coupling.

Telescopic extension (FIG. 3) is a possibility in particular for motorised chairs. There are thereby two possibilities: An existing foot can be converted into a telescopic foot. The extending foot thereby always stays in the foot area of the occupant. Or a telescopic supporting foot (7)(8)(34) and (35), as it is named in the following text, can be extended directly from under the seat diagonally to the floor as an extended foot; this telescopic supporting foot, which rests on the ground approx. 20–35 cm in front of the chair like a 6th foot, must be extended and positioned before the chair can be adjusted from the normal position into the position with sharply tilted backrest.

Movement of the telescopic supporting foot could be operated and locked in position by the foot or by a hand lever or manual crank axle. In very expensive versions of the chair, this could also be done electrically, pneumatically or hydraulically, as also for the telescopes for the chair seat movement. When extended, the telescopic supporting foot (7) reaches diagonally from under the chair down to the floor, in the frontward direction; therefore, in its extended position it is diagonally located between the legs or feet of the occupant, which would be seen as sub-optimal. An interlocking or linking device ensures that the tilt of the backrest and the position of the seat can only be changed, when this telescopic supporting foot exerts pressure on the floor; swivel movement is then also prevented. But it would appear more acceptable for the occupant to have only an extending foot that lies underneath in the foot area.

In connection with the problem of tipping over that arises in the case of movable chair seats, it is possible to distinguish 3 different situations, for which solution C appears to be the best:

A) The chair backrest (and therefore also the seat) can be fixed in any tilt position. This requires the greatest support area on the floor, as also in this position the occupant can lean his/her body forward, and hence shift the centre of gravity forward. The extending foot must rest on the floor about 35 cm in front of the chair. In the case of chairs without motorised operation, the fold-out foot offers a simple solution.

The next solutions B and C require only a smaller support area, i.e. shorter extending feet. In these cases, the extending foot must rest on the floor only about 20 cm in front of the chair.

B) The chair backrest does not lock in position and is provided with a tension spring which exerts a forward force. This solution has the disadvantage that the spring force must be precisely regulated (for any occupant weight). The occupant has constantly to fight against the potential movement and does not have a genuine backrest but only a springing back support.

C) The chair backrest is not fixable in terms of forward movement—i.e. the backrest moves forward as soon as the occupant bends forward—but is sprung with such low return force that it is just able to move the seat with the occupant, while the backrest is fixed by an additional lever only for leaning back. The occupant can therefore lean back relaxed, but the risk of tipping forward with the whole chair is reduced because the seat immediately moves backwards if the occupant bends forward and so shifts the centre of gravity. So whenever the occupant wishes to tilt the seatback further back, he/she has to operate a lever or such like in order to release the fixing mechanism. A free-wheel with hand-operated clutch would allow such free one-way movement. A ratchet mechanism could also be used, but is not continuously adjustable and causes noise. This lever could also take the form of a foot mechanism. It could also be integrated into the chair backrest and be operated by the head or special back pressure or arm pressure.

Consideration must also be given to the linkage between the extending foot on the base of the chair, the swivel movement of the chair and the tilting movement of the backrest; as otherwise an extending foot would be needed in all directions, whereas in the present case it is only necessary at the front. When the additional extending foot has been folded out at the front, the swivel movement of the chair is blocked, and only then is substantial forward movement of the seat and substantial tilting of the backrest possible.

Figure 11:
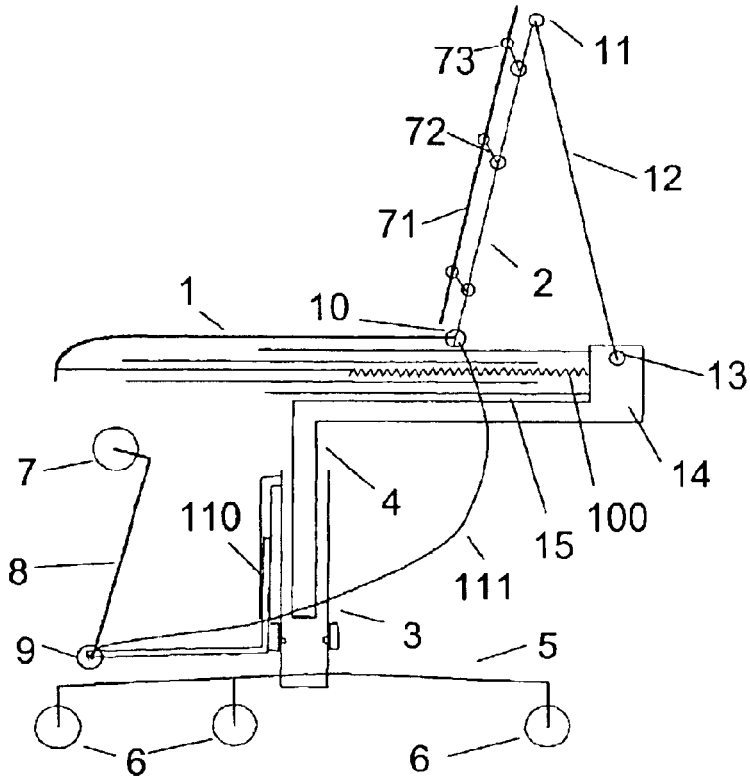
FIG. 11 shows a schematic side view chair of the invention, with a cable connection between the seat swivel and the movable foot.

The linkage can be easily effected by two cable pulls with locking pins for swiveling and sliding, or a cable pull (111) from the extending foot (7) to underneath the chair, with, perhaps, a folding lever mechanism (74) for the other purposes, since the height adjustability of the chair base must also be taken into account. In the case of chairs with electric motors, this can also be achieved by simple control logic. The extending foot can, however, also be swivel-mounted (FIG. 11) (110) on the top frame/seat with an extension piece; in this case, the base need not be positioned before the foot is folded down/out. Because of the need for height adjustability, however, this would be more difficult to design.

In place of the cable pull, a lever mechanism could also be used, possibly with Cardan universal joints. Whatever system is used, however, height adjustability of the chair must be maintained.

Figure 7:
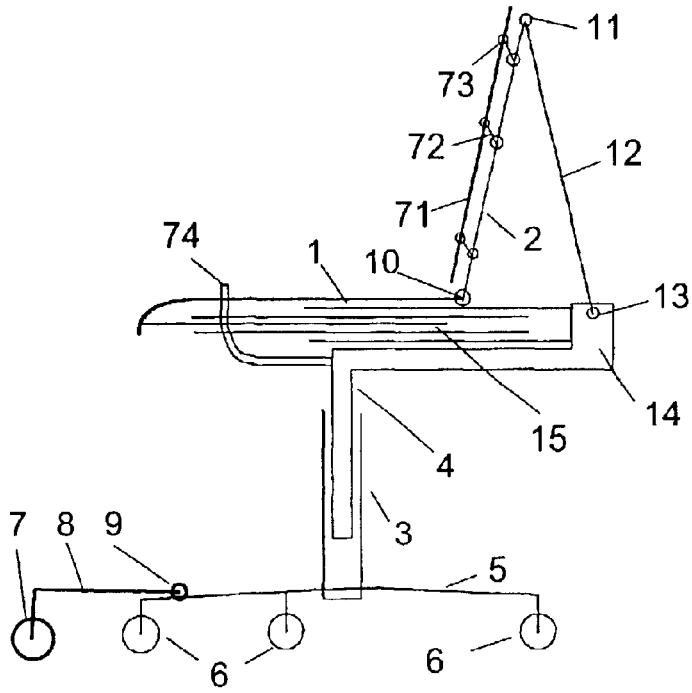
FIG. 7 shows a schematic side view of the chair of the invention, in an embodiment having a backrest parallel.
Figure 10:
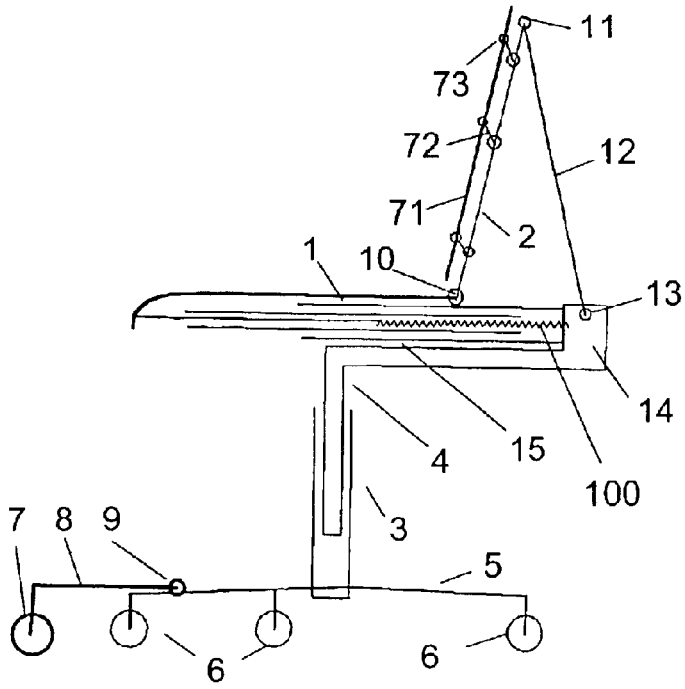
FIG. 10 shows a schematic side view of the chair of the invention, in an embodiment having a backrest parallel and a spring to effect movement of the seat.

As shown in FIGS. 7 and 10, the chair backrest itself can consist of 2 parts: the backrest (2) itself can have a second cushion element (71) or "backrest parallel" on the occupant side which is able to move slightly parallel to the backrest in sliding bearings (73) or by small levers (72); the chair backrest proper (2) is held up by springs with low force. The design of the backrest parallel (71) can be used in all of the following chairs. The purpose is to offset the compression-movement effect on the body of the occupant during tilting.

The seat (1) should be easily movable. This can be achieved by mounting it on one or two parallel telescopes with double tubes/pullouts (15) which permit large horizontal movement of the seat, while the backrest (2) is fixed to the rear of the seat (1) with one or more swivel joints (10). A long spring (100) is provided inside the telescope(s) (15) to return the seat (1) to normal position. Alternatively, return can be done by one or more springs mounted in one of the swivel joints (10) or (11). Also conceivable for this purpose would be a weight (51) mounted on cable pulls (50) to pull the seat (1) backwards.

In terms of linking the seat (1) and backrest (2) (possibly with backrest parallel (71)) and optional backrest lever with the base (3)(5), four different mechanical systems can be envisaged. A common factor to them all is that the seat (1) is linked to the bottom of the backrest (2) by a swivel joint (10), so as to allow movement/adjustment of the seat. This swivel joint (10) can naturally also be additionally provided with a clutch in order to give the chair the possibility of operating as a perfectly normal chair; in other words, the backrest can be tilted without the seat sliding forward. The difference in a) to d) is the guidance of the top point of the backrest (parallel). The length and inclination of the levers/telescopes described below can be made adjustable so as to give the occupant various adjustment options.

Figure 1:
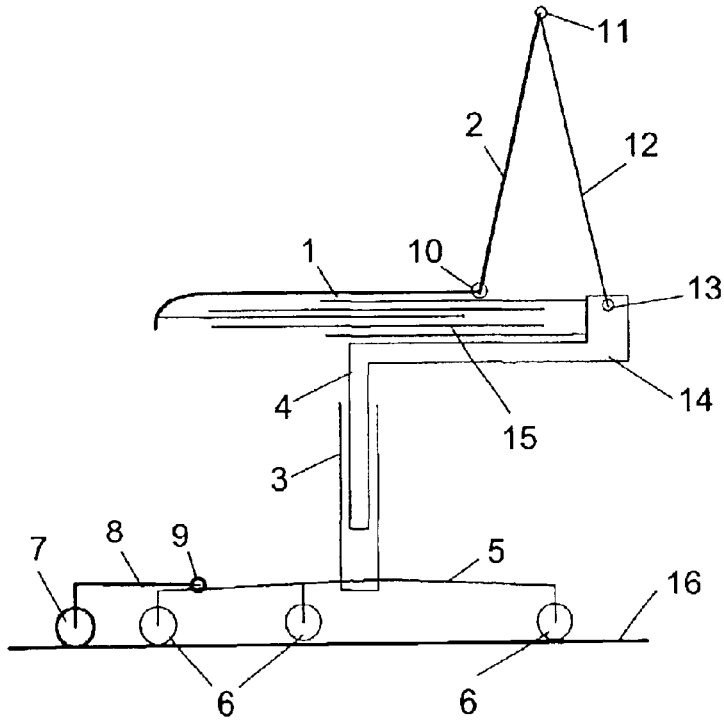
FIG. 1 shows a schematic side view of the chair of the invention.
Figure 9:
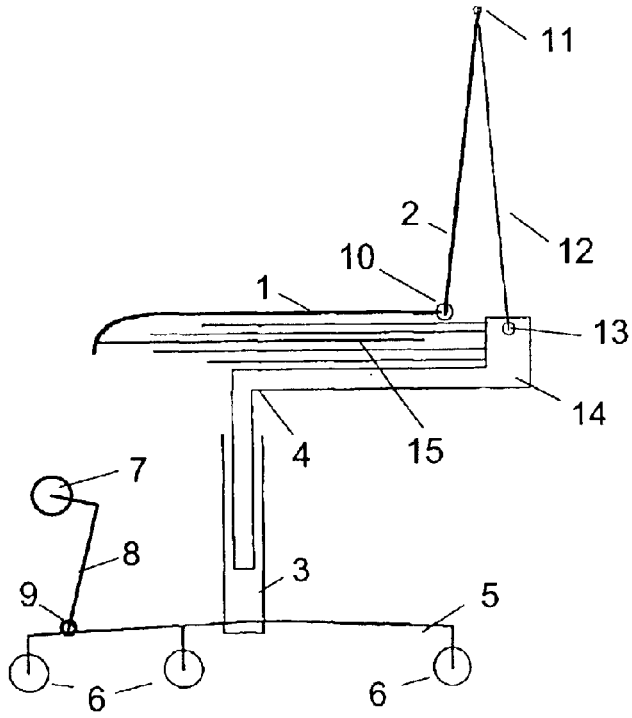
FIG. 9 shows a schematic side view of the chair of the invention, similar to FIG. 1.

In the embodiment shown in FIGS. 1 and 9, a further lever mechanism—the "backrest lever"—is mounted at the top of the backrest (parallel) with a swivel joint (11) and extends down to the base of the chair (14)—i.e. in this case the part above the vertical gas spring (3)—where it is also secured with a swivel joint (13). The seat (1) therefore moves backwards and forwards with the telescope (15).

This system therefore consists of three system components, a horizontal seat surface (1) on the telescopes (15), a backrest (2) (and parallel(71))—which may also consist of only one or two bars—and one or two other vertically rotating bars or surfaces, the backrest lever (12), as support against it; in reality, of course, several adjacent joints can be fitted for the three swivel points. The movement of the whole structure is similar to the movement of the piston rod in an engine, except that instead of a complete circular movement, only less than half a circle is performed.

The backrest lever is made adjustable to the different needs of the occupant, e.g. through an adjustable coupling point on the backrest parallel.

For safety reasons, the mechanics at the rear of the chair are housed in a bellows to prevent the risk of injury. This also gives the chair a more homogenous appearance. For the same reason, it is also better to use only one bar for the backrest lever.

For noise reasons, the double-tube telescopes (15) could be mounted in plastic ball bearings. Simple sliding bearings may also be sufficient, though in this case problems may be caused by friction. The movement of the seat (1) can be locked with one hand.

Figure 2:
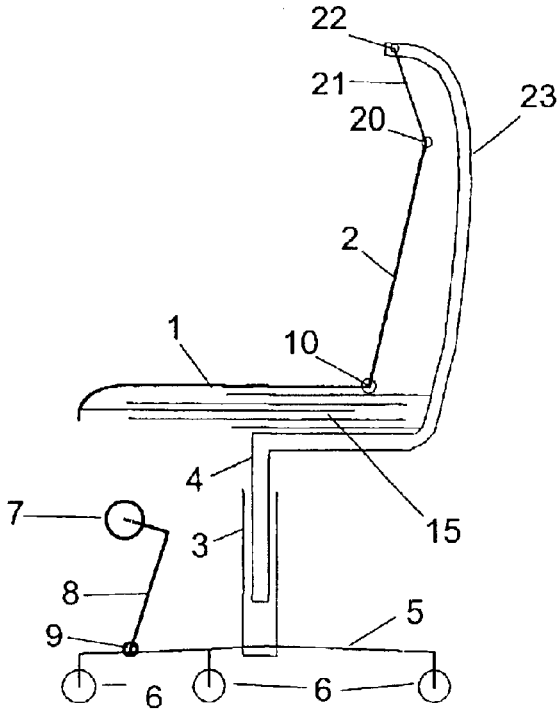
FIG. 2 shows a schematic side view of the chair of the invention, in an embodiment with a short lever at the top of the backrest.
Figure 8:
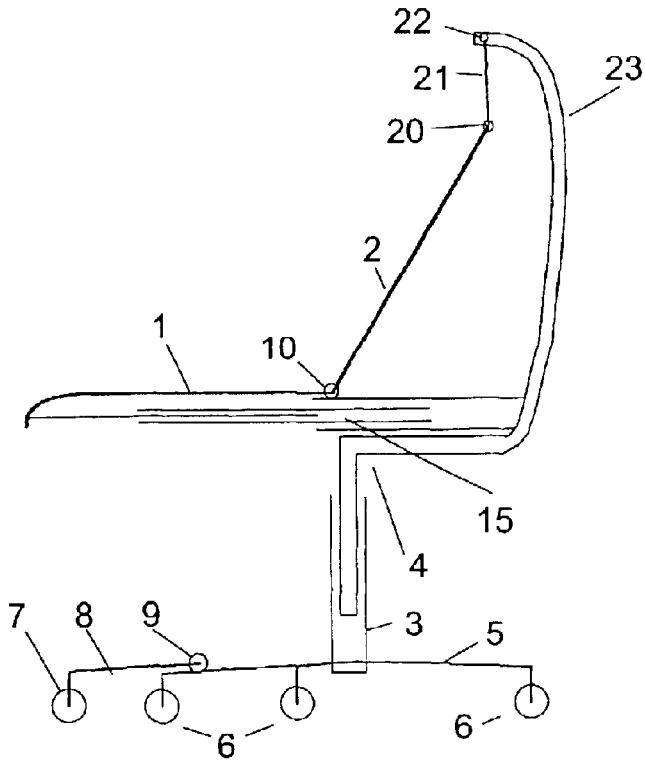
FIG. 8 shows a schematic side view of the chair of the invention, similar to FIG. 2.

In an embodiment shown in FIGS. 2 and 8, the backrest (2) has a smaller lever (21) at the top of each side, linked by a swivel joint (20) and also connected by a swivel joint (22) to a vertical extension (23) from the base of the chair. However, this requires very high chairs.

Figure 3:
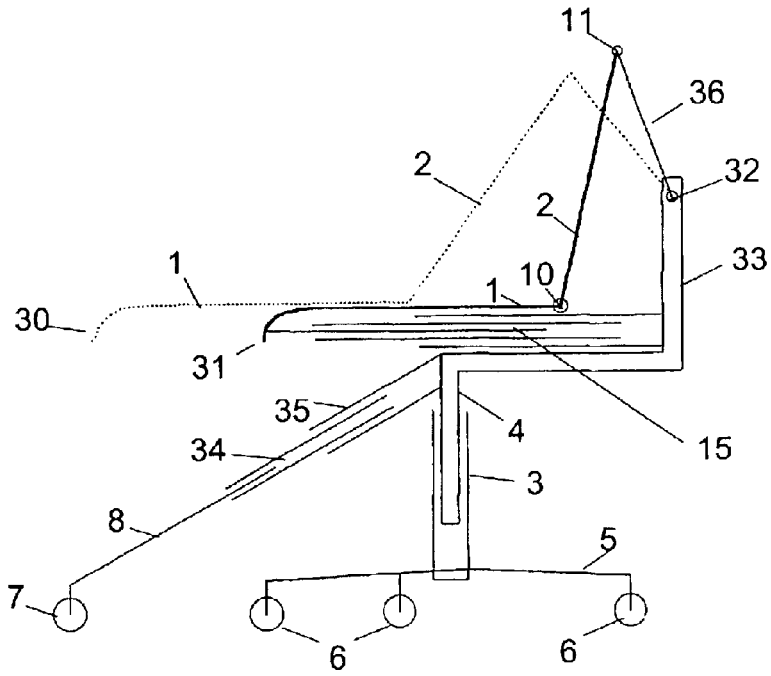
FIG. 3 shows a schematic side view of the chair of the invention, in an embodiment having a short lever at the top of the backrest and a vertical extension of the base, and also a telescoping movable foot.

In the embodiment of FIG. 3, the backrest (2) has a smaller lever (36) at the bottom of each side or in the middle, linked by a swivel joint (11) and also connected by a swivel joint (32) to a vertical extension (33) from the base of the chair.

Figure 4:
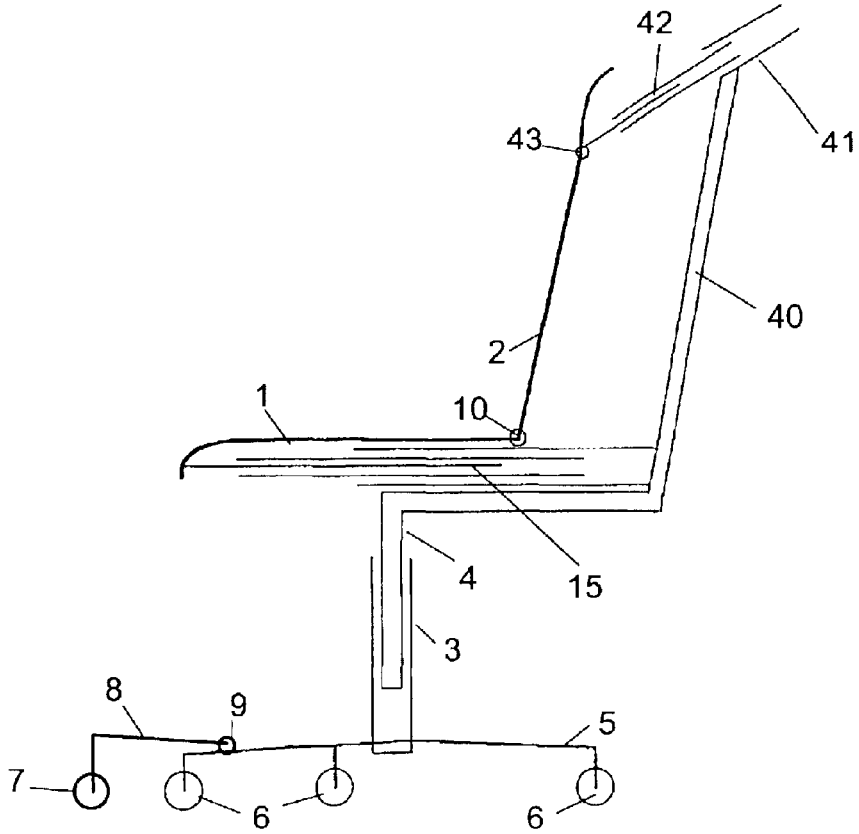
FIG. 4 shows a side view of the chair of the invention, with a telescoping support for the backrest.

In the embodiment of FIG. 4, the backrest (2) has a shorter (double-tube) telescopic extension (41)(42) at the top of each side or in the middle, running diagonally upwards at the back and connected to a vertical extension (40) from the base. The inclination of this telescope could possibly be made adjustable.

A benefit of the invention is that the occupant is able to change his/her position on the chair by adjusting the backrest (2) from upright position to tilted position, and so lessen the risk of back problems. The chair nevertheless offers support for the body. The position of the extended hand relative to the work desk changes only slightly, while the seat (1) moves backwards and forwards when the tilt of the backrest (2) is changed.

An electrically operated chair may be optically more attractive and more convenient to use. Depending on the number of motors installed, the various components can be controlled separately. However, this renders the chair more complex, with a resulting decrease in reliability. And it produces the further disadvantage that the chair requires a cable connection or battery. On the other hand, it has the advantage of allowing the occupant to adjust the parameters extremely slowly and continuously within a given range. All these systems can naturally also be equipped with the customary adjustment possibilities for swinging, tilting, chair back adjustment and so on.

In the basic version, armrests are not provided as the patented moveable armrests as per the present inventor's U.S. Pat. No. 6,267,336 are very well suited for combination with this chair as they allow movement of up to 1 m, so the movement of 35 cm intended by the present chair could easily be achieved.

If these moveable armrests are not used, armrests are preferably mounted on the seat so that their position relative to the occupant remains more or less unchanged. By small levers, they can be made additionally adjustable with the movements of the occupant.

It would also be conceivable to provide the chair as standard with somewhat lower support elements in place of the armrests (74)(FIG. 7), which would facilitate tilting backwards by giving points for support; these could be upgraded to armrests if desired.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A chair, comprising:

a) a base;

b) at least one extending foot, mounted to the chair and capable of movement from an extended position upon a floor to a non-extended position;

c) a seat supported on the base, the seat having a front and a rear and being movable horizontally forwards and backwards;

d) a tilting backrest located to the rear of the seat, the seat movement being coupled to a tilt of the backrest, such that greater tilt of the backrest is associated with forward movement of the seat;

the movement of the seat and the tilting of the backrest being coupled to the extending foot such that the tilting of the backrest and the forward movement of the seat are blocked when the extending foot is in the non-extended position.

2. The chair of claim 1, in which the seat is supported on the base by a swivel, and the swivel is coupled to the moveable foot such that the swivel locks when the extending foot has been moved to the extended position preventing the chair from swivelling.

3. The chair of claim 2, in which the swivel, the extending foot and the horizontal movement of the seat are coupled by a mechanism selected from a group comprising cable pulls, lever systems, a combination of cable pulls and levers, and electric, pneumatic or hydraulic means in combination with locking pins or locking clutches.

4. The chair of claim 1, in which the seat is horizontally movable by sliding or moving on telescopic rails or double-pullout telescopes.

5. The chair of claim 1, in which the backrest comprises a backrest for supporting an occupant of the chair and a backrest parallel which is coupled to the seat and mounted adjacent to the backrest, the backrest parallel being movable relative to the backrest.

6. The chair of claim 5, in which the backrest parallel is movably mounted to the backrest by slides or by small turning levers between the backrest and the backrest parallel, and the backrest parallel is pulled upwards by springs.

7. The chair of claim 1, further comprising a lever coupling the backrest to the base, being attached to a top end of the backrest with a swivel joint, and attached to the base with a swivel joint.

8. The chair of claim 1, further comprising a lever linking the movement of the seat and the backrest, the lever being connected to the backrest by a swivel joint, at a top of each side or in a middle, which lever is in turn connected by a swivel joint to a vertical extension from the base of the chair.

9. The chair of claim 1 in which the movement of the seat and the backrest is linked by a mechanical system in which the backrest has a telescope at the top of each side or in the middle, which telescope runs diagonally upwards and is connected to a vertical extension from the base of the chair.

10. The chair of claim 1 further comprising bias elements for effecting a return movement of the seat.

11. The chair of claim 10, in which the bias elements are springs in a coupling between the seat and the backrest.

12. The chair of claim 10, in which the bias elements are elastic elements in or parallel to telescopes.

13. The chair of claim 1, further comprising weights at the rear of the seat in for effecting a return movement of the seat.

14. The chair of claim 1, in which the extending foot is moved between the extending position and the not extended position by a telescoping mechanism.

15. The chair of claim 1, in which the extending foot is moved between the extended position and the not extended position by a folding arm.

16. The chair of claim 1, in which the extending foot is mounted to the base.

17. The chair of claim 1, in which the extending foot is mounted to the seat.

18. The chair of claim 1, in which the forward movement of the seat and the tilting of the backrest are permitted within predetermined limits when the extending foot is in the not extended position.

19. A chair, comprising:

a) a base;

b) a seat supported on the base, the seat having a front and a rear;

c) means for moving the seat horizontally forwards and backwards;

d) a tilting backrest located to the rear of the seat;

e) means for coupling the backrest to the seat, such that greater tilt of the backrest is associated with forward movement of the seat and setting up of the backrest is associated with the backward movement of the seat;

f) at least one extending foot means mounted to the chair for preventing the tipping of the chair, movable between a non-extended position and an extended position upon the floor;

g) means for preventing forward movement of the seat and reclining movement of the backrest, coupled to the means for moving the seat and the means for tilting the backrest and the means for preventing tipping of the chair such that the means for moving the seat in forward direction and the means for reclining the backrest are locked, when the means for preventing the tipping of the chair is in the non-extended position.

* * * * *